US006542131B1

(12) United States Patent
Haapanen

(10) Patent No.: US 6,542,131 B1
(45) Date of Patent: Apr. 1, 2003

(54) APPARATUS FOR SUPPRESSING MUTUAL INTERFERENCE BETWEEN ANTENNAS

(75) Inventor: Veijo Haapanen, Espoo (FI)

(73) Assignee: Nokia Networks Oy, Espoo (FI)

( * ) Notice: Subject to any disclaimer, the term of this patent is extended or adjusted under 35 U.S.C. 154(b) by 0 days.

(21) Appl. No.: 09/914,211

(22) PCT Filed: Feb. 22, 2000

(86) PCT No.: PCT/FI00/00138

§ 371 (c)(1),
(2), (4) Date: Nov. 1, 2001

(87) PCT Pub. No.: WO00/51201

PCT Pub. Date: Aug. 31, 2000

(30) Foreign Application Priority Data

Feb. 24, 1999 (FI) ..... 990395

(51) Int. Cl.[7] ..... H01Q 21/12; H01Q 9/28
(52) U.S. Cl. ..... 343/813; 343/817; 343/795
(58) Field of Search ..... 343/700 MS, 795, 343/813, 810, 814, 815, 816, 817, 818; H01Q 21/12, 9/28

(56) References Cited

U.S. PATENT DOCUMENTS

| | | | | |
|---|---|---|---|---|
| 3,541,559 A | | 11/1970 | Evans | 343/756 |
| 3,681,770 A | | 8/1972 | Alford | 343/815 |
| 4,460,899 A | | 7/1984 | Schmidt et al. | 343/841 |
| 4,812,855 A | * | 3/1989 | Coe et al. | 343/818 |
| 5,039,994 A | | 8/1991 | Wash et al. | 343/813 |
| 6,054,961 A | * | 4/2000 | Gong et al. | 343/713 |
| 6,307,524 B1 | * | 10/2001 | Britain | 343/795 |

FOREIGN PATENT DOCUMENTS

| | | |
|---|---|---|
| EP | 973 231 | 1/2000 |
| WO | WO 98/01923 | 1/1998 |

* cited by examiner

*Primary Examiner*—Hoanganh Le
(74) *Attorney, Agent, or Firm*—Pillsbury Winthrop LLP

(57) ABSTRACT

Apparatus for suppressing mutual interference between antennas placed close to each other, said apparatus consisting of at least one elongated suppressing element (5) of electrically conductive material, fitted between the antenna radiators (11, 21) and disposed in a plane transverse to the connecting line between the antennas. The suppressing element is disposed in the direction of radiation and its length equals a quarter or a multiple of a quarter of one of the wavelengths in the frequency range of the antennas, thus functioning as a resonator tuned at least to the frequency range in question, radiating in a plane transverse to the direction of radiation of the antennas (1, 2).

4 Claims, 1 Drawing Sheet

APPARATUS FOR SUPPRESSING MUTUAL INTERFERENCE BETWEEN ANTENNAS

Figure 1:
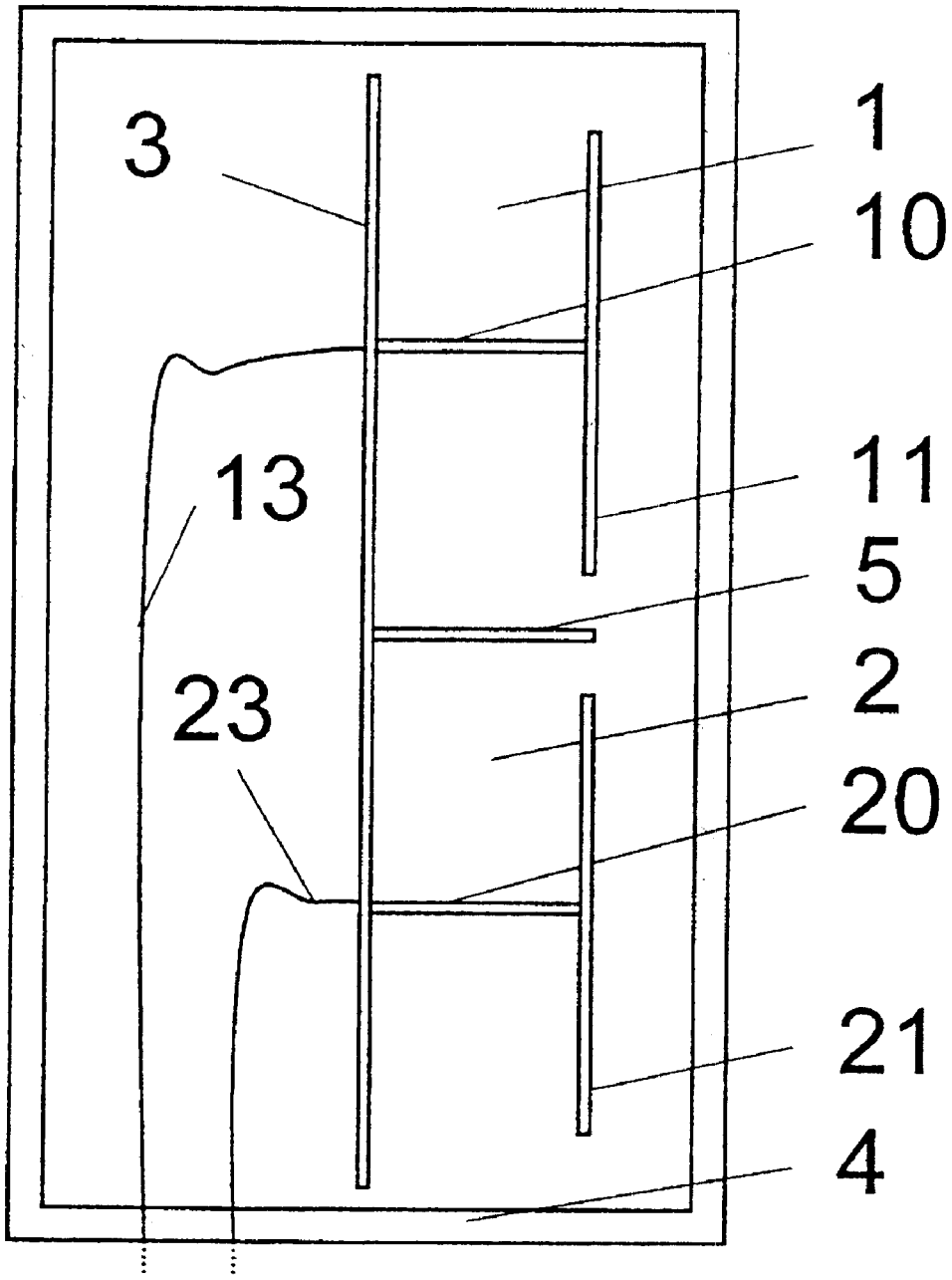

This application is the National Stage of International Application PCT/FI00/00138 which was filed on Feb. 22, 2000 and designated the U.S. This International Application was published under PCT Article 21(2) in English.

BACKGROUND OF THE INVENTION

1. Field of the Invention

The present invention relates to an apparatus for suppressing mutual interference between antennas located close to each other, said apparatus consisting of at least one elongated suppressing element of conductive material fitted between antenna radiators, disposed in a plane transverse to the connecting line between the antennas, wherein said suppressing element is disposed in the direction of radiation and has a length equal to a quarter or a multiple of a quarter of one of the wavelengths in the frequency range of the antennas, thus functioning as a resonator tuned at least to the frequency range in question, radiating in a plane transverse to the direction of radiation of the antennas. Such an apparatus is presented in U.S. Pat. No. 5,039,994.

2. Description of Related Art

The base transceiver stations of mobile communication networks use superposed dipole antennas, each antenna being connected to a separate transmitter-receiver apparatus. Such superposed antennas placed closely together produce interference in each other. For this reason, at present, superposed antennas must be placed at a relatively large distance from each other to achieve a sufficient insulation level, e.g. 26 dB, between the antennas. Therefore, the antenna structures currently used in base transceiver stations are relatively high. This is a disadvantage especially in cities, where there are many base transceiver stations within a small area and they are placed on residential and office buildings in city blocks.

Specification WO 98101923 presents a vertical cross-polarized antenna array which comprises a vertical suppression bar placed between superposed radiator modules, in a plane transverse to the direction of radiation, to suppress mutual interference between the antennas. The length of the bar is at least 25% of the distance between the radiator modules. In a dipole antenna structure presented in U.S. Pat. 3,541,559, the suppression bars are placed in a plane transverse to the direction of radiation and transversely to the connecting line between the antennas. The problem with these prior-art solutions for the suppression of interference is that they have a low interference suppression capability.

SUMMARY OF THE INVENTION

The object of the present invention is to eliminate the drawbacks associated with prior-art solutions and to achieve a new type of apparatus for suppressing mutual interference between antennas placed close to each other. The apparatus of the invention is characterized in that the antennas and the suppressing element are of electrically conductive film and etched on a fiberglass circuit plate.

Using the apparatus of the invention, it will be possible to place antennas considerably more closely together than at present. This will reduce the size of the antenna structures of e.g. base stations, allowing more inconspicuous disposition of the base stations of mobile communication networks especially in an urban environment.

DETAILED DESCRIPTION OF THE INVENTION

In the following, the invention will be described in detail by the aid of an example with reference to the attached drawing, which presents a side view of a protected dipole antenna system for a base transceiver station in the 900 MHz GSM mobile telephone network.

The antenna system comprises two dipole antennas 1, 2 placed one above the other in the same vertical plane, each of which is provided with a vertical radiator 11, 21 attached to a horizontal arm 10, 20. Placed behind these is a vertical reflector 3, the upper end of which extends slightly above the upper end of the radiator 11 of the upper antenna while the lower end extends slightly below the lower end of the radiator 21 of the lower antenna. Each antenna is connected by an antenna cable 13, 23 to a separate receiver-transmitter (Rx/Tx) apparatus. The antenna system is mounted on a supporting structure (not shown) and enclosed in a protective casing 4.

To reduce interference between the antennas 1, 2 and to achieve an adequate noise level, the antenna system is provided with a round bar or a strip 5 having the shape of an elongated rectangle, placed between the antennas despite the small distance between them and made of the same electrically conductive material as the reflector and the radiators, said bar or strip being connected to the reflector 3 in a direction parallel to the supporting arms 10, 20 of the antennas. The length L of this bar or strip equals a quarter of the wavelength or this quantity multiplied by an odd integer, i.e.

$$L = n * \frac{\lambda}{4} \tag{1}$$

where $\lambda$ is the wavelength and n is an odd integer (1,3,5, . . . ).

The strip 5 is placed at a distance from the radiators and it functions as a resonator tuned to the frequency of 900 MHz and radiating omnidirectionally in a plane transverse to the direction of radiation (to the right in the plane of the paper sheet) of the antennas 1,2, so that only a very small proportion of the signal it receives can get from one antenna to the other. Thus, interference transmitted from one antenna to the other is substantially reduced, and still the strip 5 does not interfere with the operation of any one of the antennas.

An antenna construction of electrically conductive film comprising the antennas and the suppressing element 5 can be etched on a fiberglass circuit plate.

It is obvious to a person skilled in the art that different embodiments of the invention are not restricted to the example described above, but that they may be varied within the scope of the claims presented below. If no reflector is used, then the length of the strip or bar is equal to half the wavelength or half the wavelength multiplied by an integer.

What is claimed is:

1. An apparatus for suppressing mutual interference between antennas placed close to each other, said apparatus consisting of at least one elongated suppressing element of electrically conductive material, fitted between the antenna radiators and disposed in a plane transverse to the connecting line between the antennas, wherein said suppressing element is disposed in the direction of radiation and has a length equal to a quarter or a multiple of a quarter of one of the wavelengths in the frequency range of the antennas, thus functioning as a resonator tuned at least to the frequency range in question, radiating in a plane transverse to the direction of radiation of the antennas, wherein the antennas and the suppressing element are arranged in the same plane, and they are of electrically conductive film and etched on a fiberglass circuit plate.

2. The apparatus of claim 1, wherein the length of the suppressing element equals half the wavelength or a multiple of half the wavelength.

3. The apparatus of claim 2, comprising a reflector fitted behind the antennas, wherein the length of the suppressing element equals a quarter of the wavelength or an odd multiple of a quarter of the wavelength.

4. The apparatus of claim 3, comprising a reflector disposed in conjunction with the antennas, wherein the suppressing element is connected to the reflector.

* * * * *